US006134808A

United States Patent [19]

Yapel et al.

[11] Patent Number: 6,134,808

[45] Date of Patent: Oct. 24, 2000

[54] GAP DRYING WITH INSULATION LAYER BETWEEN SUBSTRATE AND HEATED PLATEN

[75] Inventors: Robert A. Yapel, Oakdale; Gary Lee Huelsman, St. Paul; Tom M. Milbourn, Mahtomedi; William Blake Kolb, St. Paul, all of Minn.

[73] Assignee: Minnesota Mining and Manufacturing Company, St. Paul, Minn.

[21] Appl. No.: 09/080,914

[22] Filed: May 18, 1998

[51] Int. Cl.[7] ..... F26B 7/00

[52] U.S. Cl. ..... 34/421; 34/463; 34/469; 34/73; 34/79

[58] Field of Search ..... 34/421, 463, 469, 34/73, 79

[56] References Cited

U.S. PATENT DOCUMENTS

| | | | |
|---|---|---|---|
| 1,592,078 | 7/1926 | Cano . | |
| 4,365,423 | 12/1982 | Arter et al. | 34/23 |
| 4,413,425 | 11/1983 | Candor . | |
| 4,999,927 | 3/1991 | Durst et al. | 34/23 |
| 5,581,905 | 12/1996 | Huelsman et al. | 34/421 |
| 5,694,701 | 12/1997 | Huelsman et al. | 34/421 |
| 5,743,022 | 4/1998 | Hall Taylor . | |

FOREIGN PATENT DOCUMENTS

| | | | |
|---|---|---|---|
| 1 401 041 | 7/1975 | Austria | B01D 5/00 |
| 862460 | 3/1961 | United Kingdom . | |
| 1 401 041 | 7/1975 | United Kingdom . | |

OTHER PUBLICATIONS

"Bonar Media Wipe", *Bonar Fabrics; A Low & Bonar Company*, (1 page).

"Model 532, Ultrawipe Web Cleaner", *Static Control Systems/3M*, (8 pages).

Cohen, Edward et al., "Modern Coating and Drying Technology", *VCH Publishers, Inc.*, pp. 267–302 (1992).

Kroll, K. et al., "Drying Since the Millenniums", *Drying '80, Proceedings of the Second International Symposium*, vol. 2, pp. 485–494.

*Primary Examiner*—William Doerrler
*Assistant Examiner*—Malik N. Drake
*Attorney, Agent, or Firm*—William K. Weimer

[57] ABSTRACT

A gap drying system moves a substrate having a coated side and a non-coated side between a heated platen disposed on the non-coated side of the substrate and a condensing platen disposed on the coated side of the substrate. An insulation layer is disposed between the heated platen and the non-coated side of the substrate.

22 Claims, 5 Drawing Sheets

GAP DRYING WITH INSULATION LAYER BETWEEN SUBSTRATE AND HEATED PLATEN

TECHNICAL FIELD

The present invention generally relates to a method and apparatus for drying liquid coatings on a substrate, and more particularly relates to a gap drying system having a substrate traveling over a heated platen where a thin layer of fluid is typically entrapped between the substrate and the heated plate.

BACKGROUND OF THE INVENTION

Drying coated substrates, such as webs, typically requires heating the coated substrate to cause liquid to evaporate from the coating. The evaporated liquid is then removed. In typical conventional impingement drying systems for coated substrates, one or two-sided impingement dryer technology is utilized to impinge air to one or both sides of a moving substrate. In such conventional impingement dryer systems, air supports and heats the substrate and can supply heat to both the coated and non-coated sides of the substrate. For a detailed discussion of conventional drying technology see E. Cohen and E. Gutoff, *Modern Coating and Drying Technology* (VCH publishers Inc., 1992). In a gap drying system, such as taught in the Huelsman et al. U.S. Pat. No. 5,581,905 and the Huelsman et al. U.S. Pat. No. 5,694,701, which are herein incorporated by reference, a coated substrate, such as a web, typically moves through the gap drying system without contacting solid surfaces. In one gap drying system configuration, heat is supplied to the backside of the moving web to evaporate solvent and a chilled platen is disposed above the moving web to remove the solvent by condensation. The gap drying system provides for solvent recovery, reduced solvent emissions to the environment, and a controlled and relatively inexpensive drying system. In the gap drying system, the web typically is transported through the drying system supported by a fluid, such as air, which avoids scratches on the web.

As is the case for impingement dryer systems, previous systems for conveying a moving web without contacting the web typically employ air jet nozzles which impinge an air jet against the web. Most of the heat is typically transferred to the back side of the web by convection because of the high velocity of air flow from the air jet nozzles. Many impingement dryer systems can also transfer heat to the front side of the web. In an impingement dryer system, the air flow is highly nonuniform, which leads to a non-uniform heat transfer coefficient. The heat transfer coefficient is relatively large in the region close to the airjet nozzle which is referred to as the impingement zone. The heat transfer coefficient is relatively low in the region far from the air jet nozzle where the air velocity is significantly smaller and tangential to the surface. The non-uniform heat transfer coefficient can lead to drying defects. In addition, it is difficult to uniformly control the amount of energy supplied to the backside of the web because the air flow is turbulent and complex. The actual effect of operating parameters on the drying rate can usually only be determined after extensive trial and error experimentation.

One method of obtaining a more uniform heat transfer coefficient to the web is to supply energy from a heated platen to the backside of the web by conduction through a fluid layer between the heated platen and the moving web. The amount of energy supplied to the backside of the web is a function of the heated platen temperature and thickness of the fluid layer between the heated platen and the moving web. In this situation, the heat transfer coefficient is inversely proportional to the distance between the heated platen and the moving web. Therefore, in order to obtain large heat transfer coefficients which are comparable to those obtained by air impingement drying systems, the distance between the moving web and the heated platen needs to be very small. In many applications, the web must not touch the heated platen to prevent scratches from occurring in the web. However, in some applications a degree of contact between the web and the heated platen is not detrimental to a product produced from the web coated material and high heat transfer rates are required or desired. In these other types of applications, it is advantageous to have the capability of metering away a sufficient amount of the fluid layer to enable the web to contact the heated platen.

In certain gap drying system applications, the heat transfer from the heated platen through the fluid layer to the moving web becomes non-uniform. In such an application, the non-uniform heat transfer from the heated platen to the moving web causes non-uniform drying of the coating on the substrate which produces drying patterns on the dried coated web.

For reasons stated above and for other reasons presented in greater detail in the Description of the Preferred Embodiments section of the present specification, a drying system is desired which provides more uniform heat transfer to the moving coated substrate and more uniform drying of the coating on the substrate to thereby reduce the incidence of drying patterns on the coated substrate caused by non-uniform heat transfer. In addition, there is a need for a drying system where the heat transfer and drying rates are more easily controlled.

SUMMARY OF THE INVENTION

The present invention provides a system and method of gap drying a substrate having a coated side and a non-coated side. A heated platen is disposed on the non-coated side of the substrate. A condensing platen is disposed on the coated side of the substrate. An insulation layer is disposed between the heated platen and the non-coated side of the substrate. The substrate is moved between the heated platen and the condensing platen.

In one embodiment, a fluid layer is disposed between the substrate and the insulation layer. In another embodiment, a back clearance distance is defined between a bottom surface of the non-coated side of the substrate and a top surface of the heated platen, and the insulation layer fills the back clearance distance.

In one embodiment, the insulation layer is moved between the heated platen and the substrate. In this embodiment, the insulation layer is moved in a direction opposite to the direction in which the substrate is moved.

The insulation layer preferably comprises a material that has a thermal conductivity lower than that of the heated platen.

The gap drying system and method of the present invention provides more uniform heat transfer to the moving coated substrate and more uniform drying of the coating on the substrate than conventional gap drying systems. Thus, the gap drying system of the present invention reduces the incidence of drying patterns on the coated substrate caused by non-uniform heat transfer. In addition, the gap drying system of the present invention can be utilized to control the heat transfer to the coated substrate and the drying rates of the coated substrate.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Conventional Gap Drying System

Figure 1:
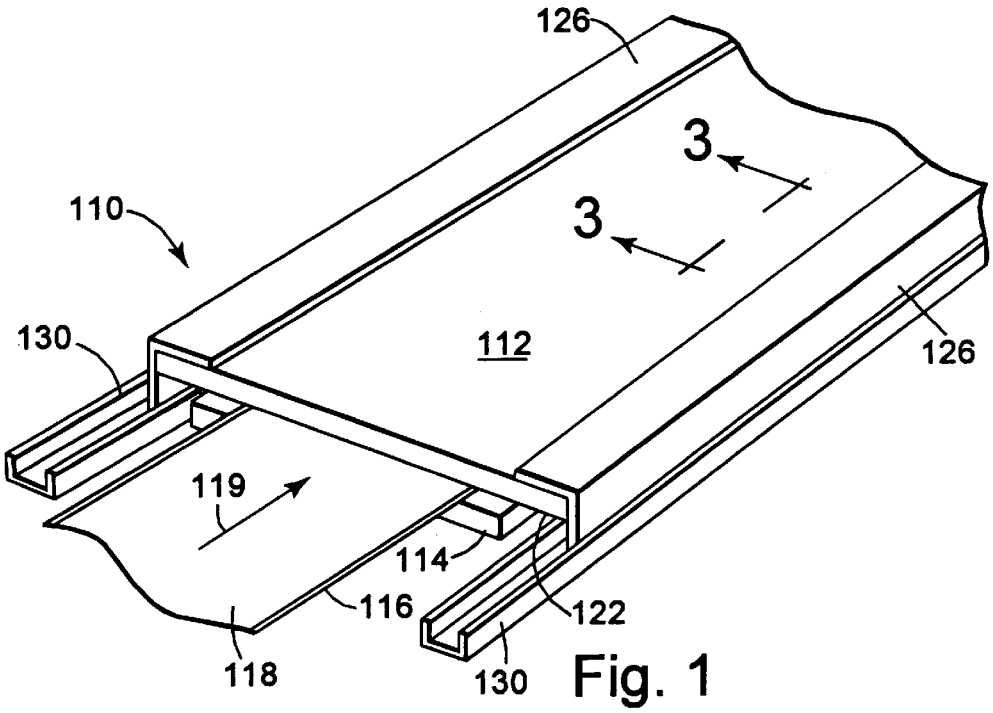
FIG. 1 is a perspective view of a conventional gap drying system.
Figure 2:
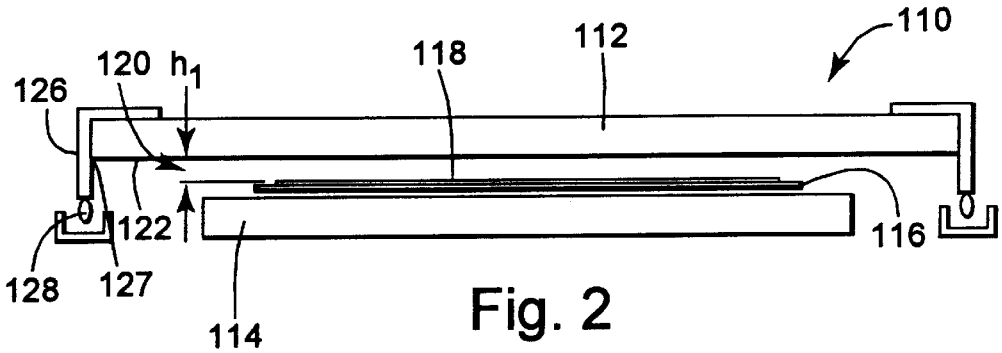
FIG. 2 is an end view of the gap drying system of FIG. 1.

A conventional gap drying system is illustrated generally at 110 in FIGS. 1 and 2. Gap drying system 110 is similar to the gap drying systems disclosed in the above incorporated Huelsman et al. Patents '905 and '701. Gap drying system 110 includes a condensing platen 112 spaced from a heated platen 114. In one embodiment, condensing platen 112 is chilled. A moving substrate or web 116, having a coating 118, travels between condensing platen 112 and heated platen 114 at a web speed V in a direction indicated by arrow 119. Some example substrate or web materials are paper, film, plastic, foil, fabric, and metal. Heated platen 114 is stationary within gap drying system 110. Heated platen 114 is disposed on the non-coated side of web 116, and there is typically a small fluid clearance, indicated at 132, between web 116 and platen 114. Condensing platen 112 is disposed on the coated side of web 116. Condensing platen 112, which can be stationary or mobile, is placed above, but near the coated surface. The arrangement of condensing platen 112 creates a small substantially planar gap 120 above coated web 116.

Heated platen 114 eliminates the need for applied convection forces below web 116. Heated platen 114 transfers heat substantially without convection through web 116 to coating 118 causing liquid to evaporate from coating 118 to thereby dry the coating. Heat typically is transferred dominantly by conduction, and slightly by radiation and convection, achieving high heat transfer rates. This evaporates the liquid from coating 118 on web 116. Evaporated liquid from coating 118 then travels across gap 120 defined between web 116 and condensing platen 112 and condenses on a condensing surface 122 of condensing platen 112. Gap 120 has a height indicated by arrows $h_1$.

Heated platen 114 is optionally surface treated with functional coatings. Examples of functional coatings include: coatings to minimize mechanical wear or abrasion of web 116 and/or platen 114; coatings to improve cleanability; coatings having selected emissimity to increase radiant heat transfer contributions; and coatings with selected electrical and/or selected thermal characteristics.

Figure 3:
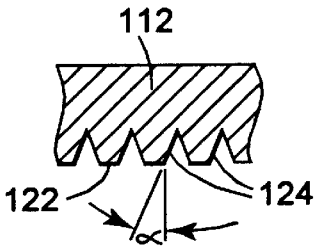
FIG. 3 is a partial cross-sectional view taken along line 3—3 of FIG. 1.

FIG. 3 illustrates a cross-sectional view of condensing platen 112. As illustrated, condensing surface 122 includes transverse open channels or grooves 124 which use capillary forces to move condensed liquid laterally to edge plates 126. In other embodiments, grooves 124 are longitudinal or in any other direction.

When the condensed liquid reaches the end of grooves 124, it intersects with an interface interior corner 127 between edge plates 126 and condensing surface 122. Liquid collects at interface interior corner 127 and gravity overcomes capillary force and the liquid flows as a film or droplets 128 down the face of the edge plates 126, which can also have capillary surfaces. Edge plates 126 can be used with any condensing surface, not just one having grooves. Condensing droplets 128 fall from each edge plate 126 and are optionally collected in a collecting device, such as collecting device 130. Collecting device 130 directs the condensed droplets to a container (not shown). Alternatively, the condensed liquid is not removed from condensing platen 112 but is prevented from returning to web 116. As illustrated, edge plates 126 are substantially perpendicular to condensing surface 122, but edge plates 126 can be at other angles with condensing surface 122. Edge plates 126 can have smooth, capillary, porous media, or other surfaces.

Alternatively, other mechanisms arc used to move condensed liquid from condensing surface 122 to prevent the condensed liquid from returning to web 116. For example, mechanical devices, such as wipers, belts, or scrapers, or any combination thereof, can be used instead of platens to remove condensed liquid. In one embodiment, fins on condensing surface 122 are used to remove the condensed liquid. In one embodiment, condensing surface 122 is tilted to use gravity to flow liquid. A capillary surface could be used to force or pump liquid to a higher elevation before or instead of using gravity. In addition, forming condensing surface 122 as a capillary surface facilitates removal of the condensed liquid.

Heated platen 114 and condensing platen 112 optionally include internal passageways, such as channels. A heat transfer fluid is optionally heated by an external heating system (not shown) and circulated through the internal passageways in heated platen 114. The same or a different heat transfer fluid is optionally cooled by an external chiller and circulated through passageways in the condensing platen 112. There are many other suitable known mechanisms for heating platen 114 and cooling platen 112.

Figure 4:
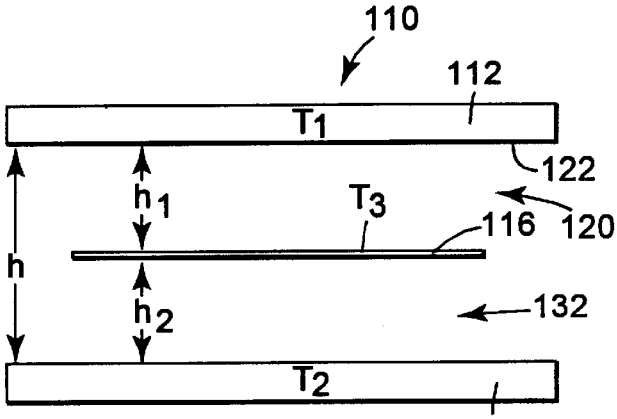
FIG. 4 is a schematic diagram side view illustrating process variables of the gap drying system of FIG. 1.

FIG. 4 illustrates a schematic side view of conventional gap drying system 110 to illustrate certain process variables. Condensing platen 112 is set to a temperature $T_1$, which can be above or below ambient temperature. Heated platen 114 is set to a temperature $T_2$, which can be above or below ambient temperature. Coated web 116 is defined by a varying temperature $T_3$.

A distance between the bottom surface (condensing surface 122) of condensing platen 112 and the top surface of heated platen 114 is indicated by arrows h. A front gap distance between the bottom surface of condensing platen 112 and the top surface of the front (coated) side of web 116 is indicated by arrows hl. A back clearance distance between the bottom surface of the backside (non-coated side) of web 116 and the top surface of heated platen 114 is indicated by arrows $h_2$. Thus, the position of web 116 is defined by distances $h_1$ and $h_2$. In addition, distance h is equal to $h_1$ plus $h_2$ plus the thickness of coated web 116.

Heat transfer to web 116 is obtained by supplying energy to the backside of web 116 dominantly by conduction, and slightly by convection and radiation, through thin fluid layer l32 between heated platen 114 and moving web 116. Examples of fluid layer 132 include, but are not limited to air, ionized air, and nitrogen. The amount of energy supplied to the backside of web 116 is determined by platen temperature $T_2$ and the thickness of fluid layer 132, which is indicated by arrows $h_2$. Assuming conduction is dominant, the energy flux (Q) is given by the following Equation I:

Equation I $$Q=k_{FLUID}(T_2-T_3)/h_2$$

Where, $k_{FLUID}$ is thermal conductivity of fluid;

$T_2$ is the heated platen temperature;

$T_3$ is the web temperature; and $h_2$ is the back clearance distance between the bottom (non-coated) surface of the web and the top surface of the heated platen.

Equation I includes a simplified heat transfer coefficient which is equal to $K_{FLUID}/h_2$. According to the heat transfer coefficient portion of equation I, larger heat transfer coefficients are obtained with relatively small back clearance distances $h_2$. In many applications of gap drying system 110, web 116 must not touch heated platen 114 to prevent scratches from occurring in web 116. However, in some applications of gap drying system 110, a degree of contact between web 116 and heated platen 114 is not detrimental to a product produced from web 116 coated material and high heat transfer rates are required or desired. In these other types of applications of gap drying system 110, it is advantageous to have the capability of metering away a sufficient amount of fluid layer 132 to enable web 116 to contact heated platen 114. Example ranges of back clearance distance $h_2$ are from approximately zero (for dragging web) to 0.1 inches, or more.

The simplified heat transfer coefficient portion of Equation I applies when back clearance distance $h_2$ is sufficiently small so that fluid flow in the back clearance between heated platen 114 and moving web 116 is laminar. The heat transfer coefficient on the backside of web 116 is a function of the thermal conductivity of fluid ($k_{FLUID}$) and back clearance distance $h_2$, in addition to any other radiant heat transfer contribution.

Assuming the front gap $h_1$ is small enough to ensure laminar flow under the gap drying conditions, the mass transfer of solvent from the front coated surface of web 116 to condensing platen 112 is a function of the diffusion coefficient of the solvent in fluid ($D_{i,\ fluid}$) and front gap distance $h_1$ as given by the following equation II:

Equation II $$kg_i=(D_{i,fluid}Mw_iP_{atm})/(h_1RT_1)$$

Where, $kg_i$ is the mass transfer coefficient of solvent i;

$D_{i,fluid}$ is the diffusion coefficient of solvent i in fluid;

$Mw_i$ is the molecular weight of solvent i;

$P_{atm}$ is atmospheric pressure;

$h_1$ is the front gap distance between the bottom surface of the condensing platen and the top surface of the front (coated) side of web;

R is the gas constant; and $T_1$ is the condensing platen temperature.

Figure 5:
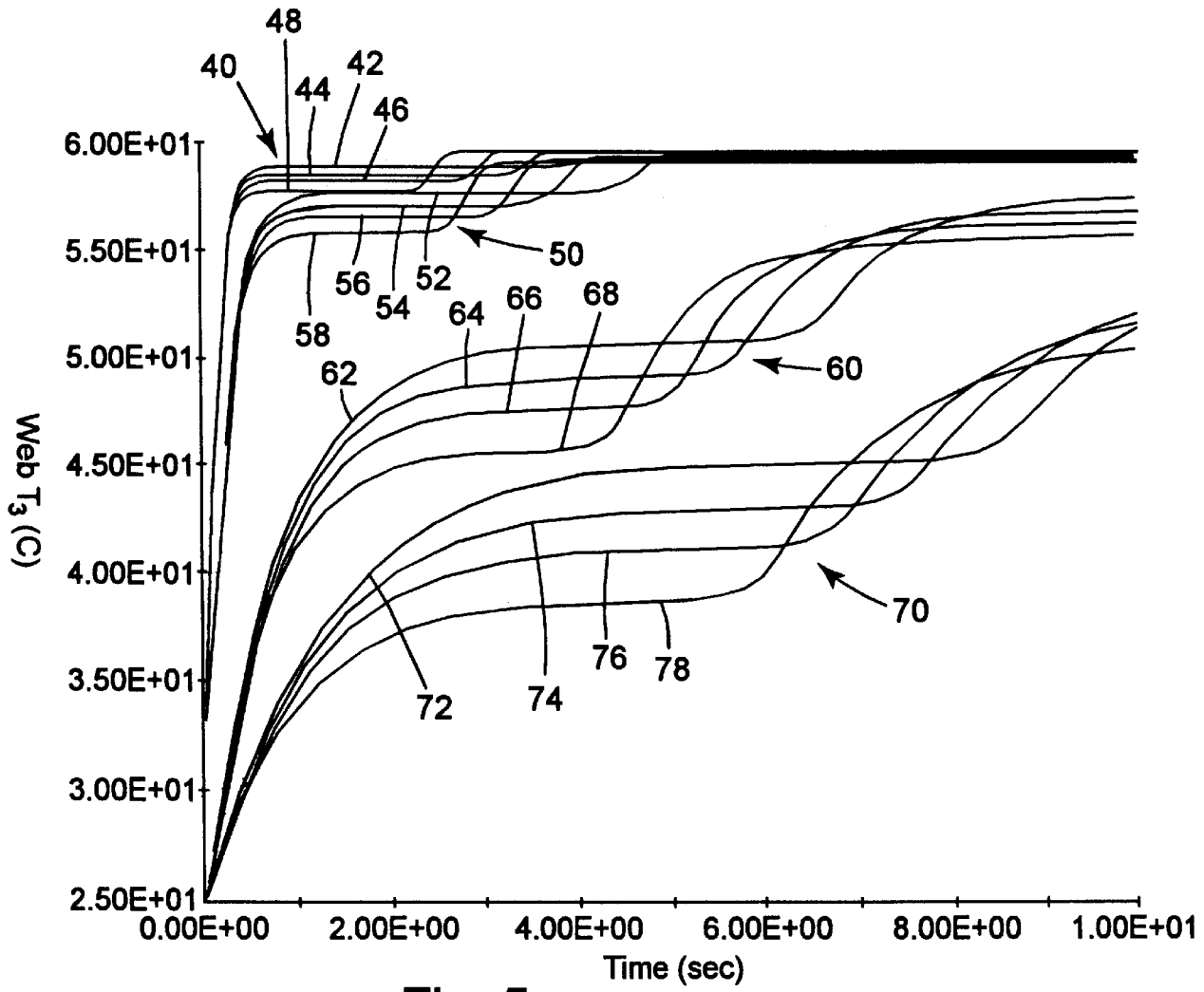
FIG. 5 is a graph plotting web temperature versus time for various front gap and back clearance distances.

The above Equations I and II can be used to derive a constant rate type drying model of conventional gap drying system 110. An example one such constant rate type drying model of gap drying system 110 derived by equations I and II is illustrated in graphical form in FIG. 5. In FIG. 5 condensing platen temperature $T_1$=18.33 degrees C and heated platen temperature $T_3$=60.0 degrees C, and web temperature $T_3$ is plotted versus time for gap drying system 110 for various values of front gap distance $h_1$ and back clearance distance $h_2$ as represented by the following curves:

curve 42 with $h_1$=0.187 inches and $h_2$=0.001 inches;
curve 44 with $h_1$=0.150 inches and $h_2$=0.001 inches;
curve 46 with $h_1$=0.125 inches and $h_2$=0.001 inches;
curve 48 with $h_1$=0.100 inches and $h_2$=0.001 inches;
curve 52 with $h_1$=0.187 inches and $h_2$=0.002 inches;
curve 54 with $h_1$=0.150 inches and $h_2$=0.002 inches;
curve 56 with $h_1$=0.125 inches and $h_2$=0.002 inches;
curve 58 with $h_1$=0.100 inches and $h_2$=0.002 inches;
curve 62 with $h_1$=0.187 inches and $h_2$=0.010 inches;
curve 64 with $h_1$=0.150 inches and $h_2$=0.010 inches;
curve 66 with $h_1$=0.125 inches and $h_2$=0.010 inches;
curve 68 with $h_1$=0.100 inches and $h_2$=0.010 inches;
curve 72 with $h_1$=0.187 inches and $h_2$=0.020 inches;
curve 74 with $h_1$=0.150 inches and $h_2$=0.020 inches;
curve 76 with $h_1$=0.125 inches and $h_2$=0.020 inches; and
curve 78 with $h_1$=0.100 inches and $h_2$=0.020 inches.

The modeling results illustrated in FIG. 5 indicate four distinct groups of curves based on back clearance distance $h_2$, which are: curve group 40 where $h_2$=0.001 inches; curve group 50 where $h_2$=0.002 inches; curve group 60 where $h_2$=0.010 inches; and curve group 70 where and $h_2$ equal to 0.020 inches. Within each of these groups, the rate of drying is lowered and web temperature $T_3$ becomes slightly higher as front gap distance $h_1$ is increased. As illustrated in FIG. 5, web temperature $T_3$ is approximately two degrees C less than heated platen temperature $T_2$ when the back clearance distance $h_2$ is 0.001 inches. However, when the back clearance distance is 0.020 inches, web temperature $T_3$ is approximately 20 degrees C less than heated platen temperature $T_2$.

FIG. 5 also graphically illustrates that the rate of drying decreases substantially as back clearance distance $h_2$ becomes larger. Therefore, deviations in the position of web 116 which result in changes in back clearance distance $h_2$ can cause differential drying and patterns in coating 118 on web 116. In addition, it is well known in the art, that temperature gradients within coating 118 cause surface tension driven flow in coating 118 leading to mottle and other undesirable patterns.

Furthermore, in many applications of gap drying system 110 it is undesirable for web 116 to bridge back clearance distance $h_2$ and contact heated platen 114. When web 116 contacts heated platen 114, the heat transfer coefficient is essentially infinite at the contact point relative to the bulk of the web. This type of contact between web 116 and heated platen 114 causes streaking type patterns to be formed in the dried coating 118 on web 116. Moreover, contact between web 116 and heated platen 114 can scratch web 116.

The modeling results illustrated in FIG. 5 indicate that at nominal operating conditions for drying, the radiant heat transfer contribution is insignificant. In addition, the modeling results illustrated in FIG. 5 indicate that web temperature $T_3$ and the drying rate are extremely sensitive to variations in the back clearance distance $h_2$.

Gap Drying Systems Having Insulation Layer Between Web and Heated Platen

Figure 6:
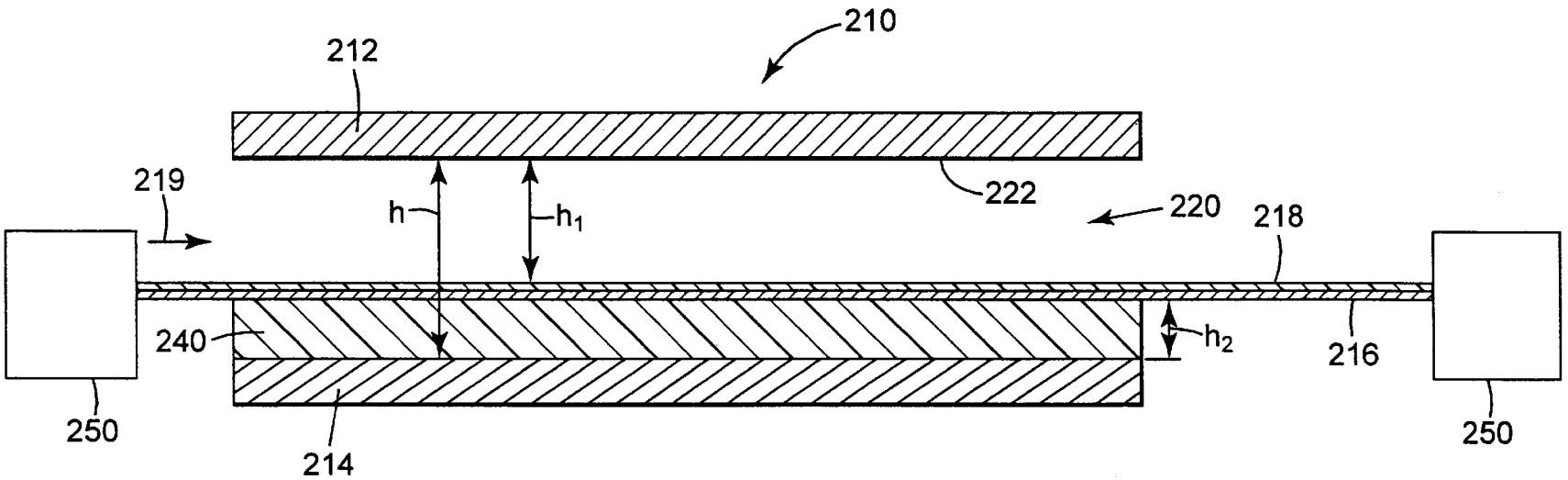
FIG. 6 is a schematic diagram cross-sectional side view of one embodiment of a gap drying system according to the present invention having an insulation layer between a moving web and a heated platen.

A gap drying system according to the present invention is illustrated generally at 210 in a cross-sectional schematic side view in FIG. 6. Gap drying system 210 is generally similar to conventional gap drying system 110 illustrated in FIGS. 1 and 2. Gap drying system 210 includes a condensing platen 212 spaced from a heated platen 214. In one embodiment, condensing platen 212 is chilled. A moving substrate or web 216, having a coating 218, travels between condensing platen 212 and heated platen 214 at a web speed V in a direction indicated by arrow 219. Means 250, which can for example include an upstream roller and a downstream roller, moves substrate 216 between condensing platen 212 and heated platen 214. Heated platen 214 is stationary within gap drying system 210. Unlike conventional gap drying system 110, gap drying system 210 includes an insulation layer 240 comprising insulating material disposed between heated platen 214 and the non-coated side of web 216. Condensing platen 212 is disposed on the coated side of web 216. Condensing platen 212, which can be stationary or mobile, is placed above, but near the coated surface of web 216. The arrangement of condensing platen 212 creates a small substantially planar gap 220 above coated web 216.

Heated platen 214 transfers heat through insulation layer 240 to web 216 and through web 216 to coating 218. The heat transferred from heated platen 214 to coating 218 causes liquid to evaporate from coating 218 to thereby dry the coating. Evaporated liquid from coating 218 then travels across gap 220 defined between web 216 and condensing platen 212 and condenses on a condensing surface 222 of condensing platen 212. Gap 220 has a height indicated by arrows $h_1$.

The operation of condensing platen 212 is similar to the operation of condensing platen 112 as discussed above with reference to FIG. 3. In addition, the process variables illustrated in FIG. 4 for conventional gap drying system 110 generally apply to gap drying system 210 of the present invention. Therefore, condensing platen 212 is set to a temperature $T_1$, which can be above or below ambient temperature. Heated platen 214 is set to a temperature $T_2$, which can be above or below ambient temperature. Coated web 216 is defined by a varying temperature $T_3$.

A distance between the bottom surface (condensing surface 222) of condensing platen 212 and the top surface of heated platen 214 is indicated by arrows h. A front gap distance between the bottom surface of condensing platen 212 and the top surface of the front (coated) side of web 216 is indicated by arrows $h_1$. A back clearance distance between the bottom surface of the backside (non-coated side) of web 216 and the top surface of heated platen 214 is indicated by arrows $h_2$. Thus, the position of web 216 is defined by distances $h_1$ and $h_2$. In addition, distance h is equal to $h_1$ plus $h_2$ plus the thickness of coated web 216.

In the embodiment illustrated in FIG. 6, insulation layer 240 is formed from insulating material which fills back clearance distance $h_2$ between the backside of web 216 and heated platen 214. Therefore, in gap drying system 210 of the present invention, insulation layer 240 is not just a fluid (e.g., air) and actually supports moving web 216 to maintain a substantially constant back clearance distance $h_2$ between moving web 216 and heated platen 214. The substantially constant back clearance distance $h_2$ results in a substantially constant heat transfer coefficient being applied to the backside of web 216. As a result of the substantially constant heat transfer coefficient, heat is more uniformly transferred from heated platen 214 to web 216 through to coating 218. The uniform heat transfer leads to a substantially uniform web temperature $T_3$ throughout web 216 and substantially uniform drying rates of coating 218. The substantially uniform web temperature $T_3$ and drying rates substantially eliminates unwanted patterns in the dried coating material 218.

Heat transfer to web 216 is obtained by supplying energy to the backside of web 116 dominantly by conduction, and slightly by convection and radiation, through insulation layer 240 between heated platen 214 and moving web 216. The amount of energy supplied to the backside of web 116 is determined by platen temperature $T_2$ and the thickness of insulation layer 240, which is indicated by arrows $h_2$. Assuming conduction is dominant, the energy flux (Q) is given by the following Equation III:

Equation III $$Q=k_{INSULATION}(T_2-T_3)/h_2$$

Where, $k_{INSULATION}$ is thermal conductivity of insulation material;

$T_2$ is the heated platen temperature;

$T_3$ is the web temperature; and $h_2$ is the back clearance distance between the bottom (non-coated) surface of the web and the top surface of the heated platen and is equal to the insulation layer height.

Equation III includes a simplified heat transfer coefficient through insulation layer 240 which is equal to $K_{INSULATION}/h_2$. Thus, the heat transfer coefficient for gap drying system 210 of the present invention is calculated similar to the heat transfer coefficient for conventional gap drying system 110, except that the thermal conductivity of insulation layer 240 ($k_{INSULATION}$) is used rather than the thermal conductivity of fluid ($k_{FLUID}$). A criteria for insulation layer 240 is that its thermal conductivity ($k_{INSULATION}$) is lower than that of heated platen 214 ($k_{PLATEN}$). Most common insulating materials hold air in the layer stagnant (i.e., substantially no convection). Thus, if this type of insulating material is used for insulation layer 240, insulation layer 240 has a thermal conductivity equal to or greater than air. Thus, according to equation III, the heat transfer coefficient through insulation layer 240 is greater than or equal to the laminar fluid clearance case represented by equation I, when the fluid is air. Consequently, the heat transfer rate and the drying rate are not typically reduced by employing insulating layer 240 according to the present invention.

According to Equation III, the heat transfer coefficient through insulation layer 240 can be selected by specifying the insulating material and the thickness of the insulation layer. The insulating material that forms insulation layer 240 preferably has a relatively small feature size (i.e., grain or cell size) so that the feature size pattern cannot transfer to the coating as a non-uniform heat transfer itself. If insulation layer 240 comprises a solid/air composite, such as a fiber material, nonwoven, granular of foam cell, the solid portion of the solid/air composite preferably has a thermal conductivity substantially close to air to substantially eliminate the possibility of differential heat transfer at touchdown of web 216 to insulation layer 240.

In addition, the insulating material that forms insulation layer 240 is preferably selected along with the material which forms web 216 to provide for scratch free drag of web 216. Also, web 216 is preferably clean of dirt prior to entry into gap drying system 210 to avoid scratches on the web.

Suitable insulating materials for insulation layer 240 include, but are not limited to felts, fabrics, non-wovens, films, open cell foams, closed cell foams, and other such insulating materials. Suitable insulating materials for insulation layer 240 can be, for example, ceramic, organic, cellulosic, or polymeric origin, provided that insulation layer 240 meets the criteria that it is thermal conductivity is lower than that of heated platen 214. Two suitable insulation layers 240 include 3M Ultra Wipe Web Cleaner, model 532 manufactured by 3M Corporation of St. Paul, Minn. and Bonar Media Wipe manufactured by Bonar Fabrics of Greenville, S.C.

For certain gap drying application, insulation layer 240 is optionally employed in gap drying system 210 to control or slow down heat transfer to web 216 from heated platen 214 for certain applications of gap drying by selecting a heat transfer coefficient by specifying the insulating material and the thickness of the insulation layer.

Figure 7:
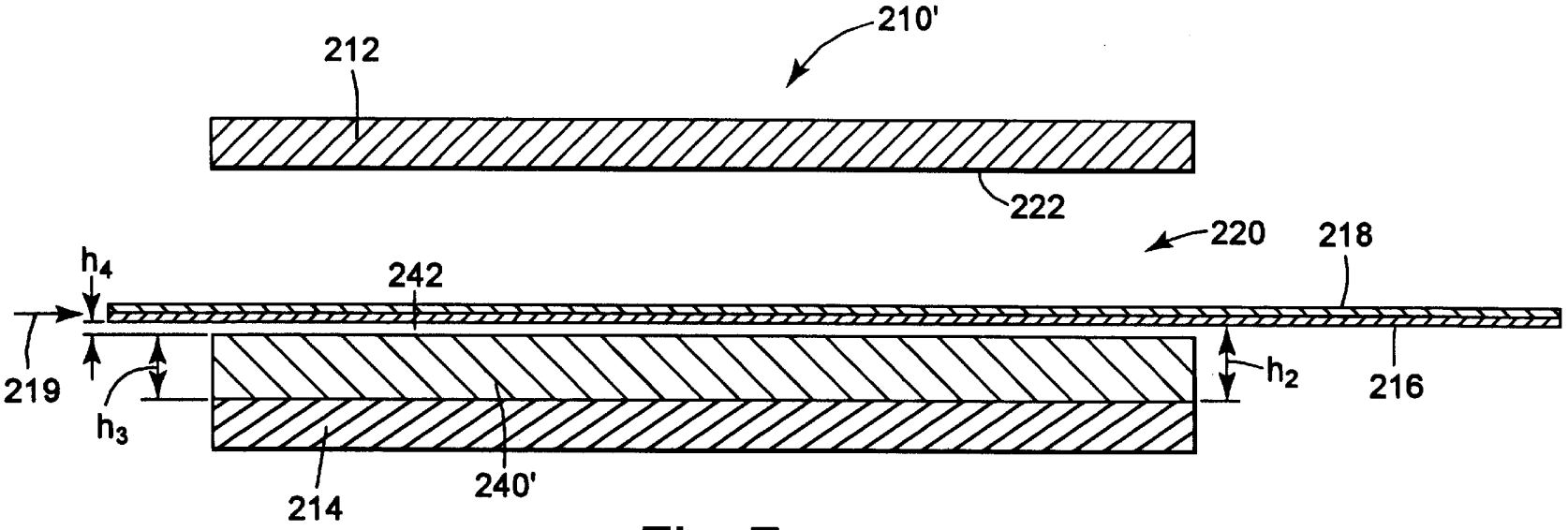
FIG. 7 is a schematic diagram cross-sectional side view of another embodiment of a gap drying system according to the present invention having an insulation layer between a moving web and a heated platen.

An alternative embodiment of a gap drying system according to the present invention is illustrated generally at 210' in FIG. 7. Gap drying system 210' is similar to gap drying system 210 illustrated in FIG. 6 and described above, except that gap drying system 210' of FIG. 7 includes an insulation layer 240' which only replaces some of the fluid in back clearance distance $h_2$ between the backside of web 216 and heated platen 214. Thus, in gap drying system 210 of FIG. 6 insulation layer 240 has a height equal to back clearance distance $h_2$. By contrast, gap drying system 210' of FIG. 7 includes insulation layer 240' having a height or thickness indicated by arrows $h_3$ and a fluid layer 242 formed between insulation layer 240' and the backside web 216. Fluid layer 242 has a height or thickness indicated by arrows $h_4$. Therefore, in gap drying system 210', the height of insulation layer 240' ($h_3$) plus the height of fluid layer 242 ($h_4$) is equal to the backside clearance distance $h_2$.

In gap drying system 210 of FIG. 6, the insulation layer drags web 216. In gap drying system 210' of FIG. 7, web 216 floats over fluid layer 242 above insulation layer 240'. Thus, in gap drying system 210' of the present invention, insulation layer 210' does not actually directly support moving web 216 to maintain a substantially constant back clearance distance $h_2$ between moving web 216 and heated platen 214. In gap drying system 210', however, complications of drag contact are reduced while still providing the benefit of better uniformity of drying over conventional gap drying systems. Gap drying system 210' especially is beneficial in situations where web 216 would touch down to heated platen 214 if insulation layer 240' was not disposed between heated platen 214 and web 216.

Figure 8:
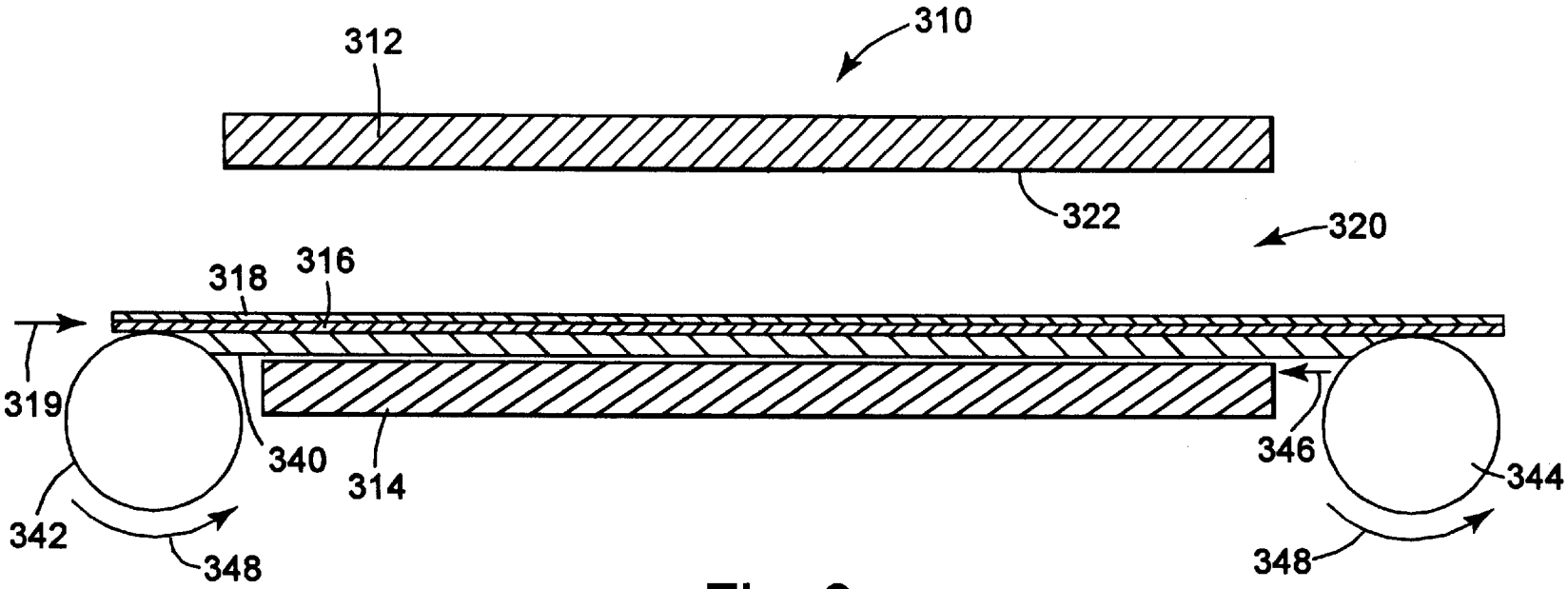
FIG. 8 is a schematic diagram cross-sectional side view of another embodiment of a gap drying system according to the present invention having a moving insulation layer between a moving web and a heated platen.

Another embodiment of a gap drying system according to the present invention is illustrated generally at 310 in a cross-sectional schematic side view in FIG. 8. Gap drying system 310 is similar to gap drying system 210 illustrated in FIG. 6 and described above. Gap drying system 310 includes a condensing platen 312 spaced from a heated platen 314. In one embodiment, condensing platen 312 is chilled. A moving substrate or web 316, having a coating 318, travels between condensing platen 312 and heated platen 314 at a web speed V in a direction indicated by arrow 319. Heated platen 314 is stationary within gap drying system 310. Gap drying system 310 includes a moving insulation layer 340 comprising insulating material disposed between heated platen 314 and the non-coated side of web 316. Condensing platen 312 is disposed on the coated side of web 316. Condensing platen 312, which can be stationary or mobile, is placed above, but near the coated surface of web 316. The arrangement of condensing platen 312 creates a small substantially planar gap 320 above coated web 316.

Heated platen 314 transfers heat through insulation layer 340 to web 316 and through web 316 to coating 318. The heat transferred from heated platen 314 to coating 318 causes liquid to evaporate from coating 318 to thereby dry the coating. Evaporated liquid from coating 318 then travels across gap 320 defined between web 316 and condensing platen 312 and condenses on a condensing surface 322 of condensing platen 312.

The operation of condensing platen 312 is similar to the operation of condensing platen 112 as discussed above with reference to FIG. 3. In addition, the process variables illustrated in FIG. 4 for conventional gap drying system 110 generally apply to gap drying system 310 of the present invention. Therefore, condensing platen 312 is set to a temperature $T_1$, which can be above or below ambient temperature. Heated platen 314 is set to a temperature $T_2$, which can be above or below ambient temperature. Coated web 316 is defined by a varying temperature $T_3$.

Gap drying system 310 includes upstream roller 342 and downstream roller 344 which continuously feed insulation layer 340 in a direction, indicated by arrow 346, which is counter to the web movement direction 319. Rollers 342 and 344 rotate in a counter clockwise direction, as indicated by arrows 348, to feed insulation layer 340 in direction 346. In gap drying system 310, the insulation layer 340 is fed at a slow speed relative to the speed V of moving web 316. In this way, a fresh layer of insulating material is maintained between moving web 316 and heated platen 314, which minimizes variations caused be wear or deposition of dirt entrained by web 316. Scratching of web 316, non-uniform heat transfer, and dirt induced drying patterns are substantially eliminated with gap drying system 310 of the present invention because dirt and other such contaminates are substantially removed from the drying region. In addition, the backside of web 316 is cleaned by moving insulation layer 340.

Conclusion

Gap drying systems according to the present invention which have an insulation layer between the moving web and the heated platen, such as gap drying systems 210, 210', and 310, provide a more uniform heat transfer to the moving coated web than that provided by conventional gap drying systems, such as conventional gap dry system 110. The more uniform heat transfer provides uniform drying of the coating on the web. Drying patterns caused by non-uniform heat transfer, are therefore substantially reduced. Furthermore, scratches to the moving web are substantially reduced with a gap drying system of the present invention. In addition, gap drying systems according to the present invention can more easily control heat transfer and drying rates.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A gap drying system comprising:

a moving substrate having a coated side and a non-coated side;

a heated platen disposed on the non-coated side of the substrate;

a condensing platen disposed on the coated side of the substrate; and an insulation layer disposed between the heated platen and the non-coated side of the substrate.

2. The gap drying system of claim 1 further comprising:

a fluid layer disposed between the substrate and the insulation layer.

3. The gap drying system of claim 1 wherein a back clearance distance is between a bottom surface of the non-coated side of the substrate and a top surface of the heated platen, and wherein the insulation layer fills the back clearance distance.

4. The gap drying system of claim 1 further comprising:

means for moving the insulation layer between the heated platen and the substrate.

5. The gap drying system of claim 4 wherein the means for moving the substrate moves the substrate in a first direction and the means for moving the insulation layer moves the insulation layer in a second direction opposite to the first direction.

6. The gap drying system of claim 1 wherein the insulation layer comprises a material that has a thermal conductivity lower than that of the heated platen.

7. A method of drying a substrate having a coated side and a non-coated side, the method comprising the steps of:

locating a first platen on the non-coated side of the substrate;

locating an insulation layer between the first platen and the non-coated side of the substrate;

locating a second platen having a condensing surface on the coated side of the substrate;

heating the first platen to caused liquid to evaporate from the coated side of the substrate to produce a coating vapor;

condensing the coating vapor on a condensing surface of the second platen; and moving the substrate between the first platen and the second platen.

8. The method of claim 7 further comprising the step of:

locating a fluid layer between the substrate and the insulation layer.

9. The method of claim 7 further comprising the steps of:

defining a back clearance distance between a bottom surface of the non-coated side of the substrate and a top surface of the first platen; and filling the back clearance distance with the insulation layer.

10. The method of claim 7 further comprising the step of:

moving the insulation layer between the first platen and the substrate.

11. The method of claim 10 the step of moving the substrate includes moving the substrate in a first direction and the step for moving the insulation layer includes moving the insulation layer in a second direction opposite to the first direction.

12. The method of claims 7 wherein the insulation layer comprises a material that has a thermal conductivity lower than that of the first platen.

13. The method of claim 7 wherein the step of condensing produces a condensate, and the method further comprises the step of:

removing the condensate from the condensing surface of the second platen.

14. The method of claim 7 further comprising the step of:

controlling heat transfer to the moving substrate by selecting an insulating material with a desired thermal conductivity to form the insulation layer.

15. The method of claim 7 further comprising the step of:

controlling heat transfer to the moving substrate by selecting a desired height of the insulation layer.

16. The gap drying system of claim 1 further comprising means for moving the substrate between the heated platen and the condensing platen.

17. The gap drying system of claim 1, wherein the condensing platen is disposed such that the condensing platen does not contact the coated side of the moving substrate.

18. The method of claim 7, wherein the condensing surface of the second platen is disposed such that the condensing surface does not contact the coated side of the substrate.

19. A gap drying apparatus for drying a liquid on a first side of a moving substrate, the moving substrate further having a second side adjacent the first side, the gap drying apparatus comprising:

a condensing platen;

a heated platen disposed adjacent the condensing platen; and an insulation layer disposed between the heated platen and the condensing platen, wherein a gap exists between the insulation layer and the condensing platen through which a moving substrate may travel.

20. The gap drying apparatus of claim 19, wherein the insulation layer does not contact the heated platen and is disposed to contact the moving substrate.

21. The gap drying apparatus of claim 19, wherein the gap between the insulation layer and the condensing platen is sufficiently large such that the condensing platen does not contact the moving substrate when traveling adjacent the condensing platen.

22. The gap drying apparatus of claim 19, further comprising means for moving the insulation layer relative to the heated platen.

* * * * *

UNITED STATES PATENT AND TRADEMARK OFFICE

CERTIFICATE OF CORRECTION

PATENT NO. : 6,134,808
DATED : October 24, 2000
INVENTOR(S) : Yapel et al.

It is certified that error appears in the above-identified patent and that said Letters Patent is hereby corrected as shown below:

Title page,
Right column, under FOREIGN PATENT DOCUMENTS, please remove the following line:
1 401 041 7/1975 Austria.....B01D 5/00

Column 5,
Line 2, "hl" should be -- $h_l$ --.

Signed and Sealed this

Fifth Day of February, 2002

*Attest:*

*Attesting Officer*

JAMES E. ROGAN
*Director of the United States Patent and Trademark Office*